US008636158B2

(12) United States Patent
Frisch

(10) Patent No.: US 8,636,158 B2
(45) Date of Patent: Jan. 28, 2014

(54) DUAL CHAMBER NURSING BOTTLE

(76) Inventor: Ruchama Frisch, Cedarhurst, NY (US)

( * ) Notice: Subject to any disclaimer, the term of this patent is extended or adjusted under 35 U.S.C. 154(b) by 842 days.

(21) Appl. No.: 11/810,003

(22) Filed: Jun. 4, 2007

(65) Prior Publication Data

US 2008/0035596 A1 Feb. 14, 2008

Related U.S. Application Data

(63) Continuation-in-part of application No. 10/735,313, filed on Dec. 11, 2003, now Pat. No. 7,225,938.

(51) Int. Cl.
*A61J 9/00* (2006.01)
*A61J 11/00* (2006.01)

(52) U.S. Cl.
USPC ..... 215/11.1; 215/6; 215/11.4

(58) Field of Classification Search
USPC ..... 215/11.1, 11.4–11.6, 6; 220/714
See application file for complete search history.

(56) References Cited

U.S. PATENT DOCUMENTS

| | | | | | |
|---|---|---|---|---|---|
| 1,937,278 | A | * | 11/1933 | Kleine | 215/11.5 |
| 2,107,442 | A | * | 2/1938 | Hughes | 215/11.4 |
| 2,372,281 | A | * | 3/1945 | Jordan | 215/11.5 |
| 2,745,568 | A | * | 5/1956 | Newton | 215/11.4 |
| 2,812,092 | A | * | 11/1957 | Witz | 215/11.1 |
| 2,876,772 | A | * | 3/1959 | Witz | 215/11.4 |
| 2,959,314 | A | * | 11/1960 | Sanchez | 215/11.1 |
| 2,987,209 | A | * | 6/1961 | Royal | 215/11.3 |
| 3,211,315 | A | * | 10/1965 | Griesinger | 215/11.1 |
| 3,635,380 | A | * | 1/1972 | Fitzgerald | 222/484 |
| 4,241,768 | A | * | 12/1980 | Keller et al. | 141/8 |
| 4,339,046 | A | * | 7/1982 | Coen | 215/11.5 |
| 4,856,995 | A | * | 8/1989 | Wagner | 433/215 |
| 5,071,017 | A | * | 12/1991 | Stull | 215/260 |
| 5,150,800 | A | * | 9/1992 | Sarter et al. | 215/11.4 |
| 5,433,328 | A | * | 7/1995 | Baron et al. | 215/11.4 |
| 5,474,193 | A | * | 12/1995 | Larsson et al. | 215/11.4 |
| 5,553,726 | A | * | 9/1996 | Park | 215/11.4 |
| 5,747,083 | A | * | 5/1998 | Raymond et al. | 426/117 |
| 5,860,541 | A | * | 1/1999 | McIntyre et al. | 215/11.4 |
| 5,897,007 | A | * | 4/1999 | Schein et al. | 215/11.1 |
| 5,938,053 | A | * | 8/1999 | Verbovszky et al. | 215/6 |
| 6,042,850 | A | * | 3/2000 | Ida et al. | 426/2 |
| 6,112,919 | A | * | 9/2000 | Ho | 215/11.4 |
| 2002/0063103 | A1 | * | 5/2002 | Kiernan | 215/11.4 |
| 2004/0035815 | A1 | * | 2/2004 | Webb et al. | 215/11.4 |
| 2004/0211745 | A1 | * | 10/2004 | Murray | 215/356 |
| 2004/0245203 | A1 | * | 12/2004 | Goldman et al. | 215/11.4 |
| 2005/0247660 | A1 | * | 11/2005 | Michalopoulos | 215/228 |
| 2007/0163983 | A1 | * | 7/2007 | Hsu | 215/11.1 |

FOREIGN PATENT DOCUMENTS

| | | | | |
|---|---|---|---|---|
| EP | 0384394 | A2 | * | 8/1990 |
| GB | 2169210 | A | * | 7/1986 |

* cited by examiner

*Primary Examiner* — Sue A Weaver
(74) *Attorney, Agent, or Firm* — Bernard Malina

(57) ABSTRACT

A dual chamber nursing bottle includes a first, relatively larger, storage chamber and a second, relatively smaller feeding chamber. A soft rubber nursing nipple is connected to the second chamber for feeding an infant. The first and second chambers are connected by a threaded closure. A transfer valve is mounted on the threaded closure to allow the transfer of selected quantities of milk from the first chamber into the second chamber.

8 Claims, 13 Drawing Sheets

FIG. 12
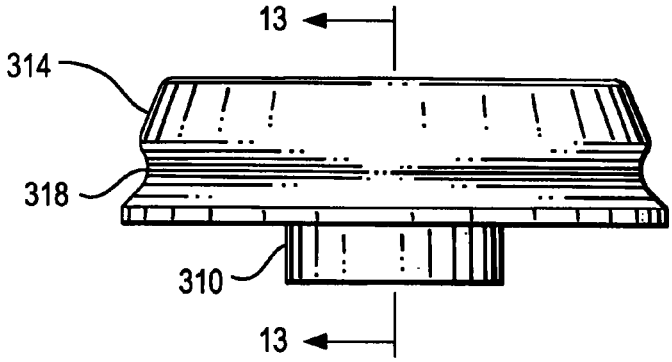
FIG. 13
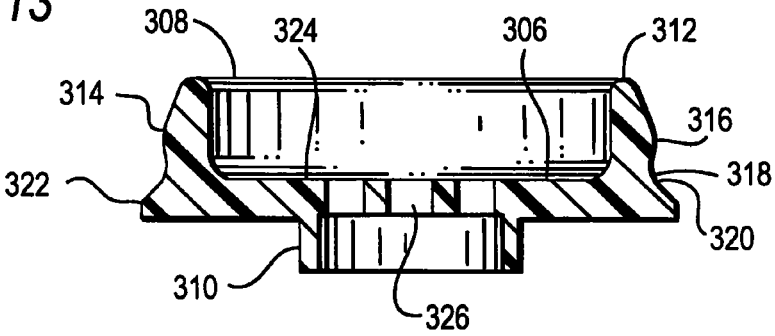
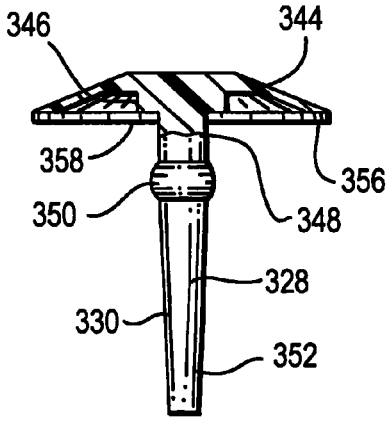
FIG. 14

DUAL CHAMBER NURSING BOTTLE

RELATED APPLICATION

This application is a Continuation-in-Part of my application entitled "Dual Chamber Nursing Bottle," U.S. patent application Ser. No. 10/735,313, filed Dec. 11, 2003, which issued on Jun. 5, 2007 as U.S. Pat. No. 7,225,938.

FIELD OF THE INVENTION

The present invention relates generally to the field of equipment for the feeding of infants and more particularly, to a dual chamber nursing bottle.

BACKGROUND OF THE INVENTION

The prior art related to equipment for feeding infants includes a range of devices which usually include a flexible nursing nipple which is mounted in the removable cap of a bottle. The cap and the bottle typically form a threaded closure.

One of the disadvantages of the apparatus according to the prior art is related to the use of the apparatus in the feeding of infants with regard to the use of breast milk and/or baby formula. When bottle feeding an infant using breast milk or formula, the infant oftentimes does not drink all the milk. Because both breast milk and infant formula have significant value, it would be desirable to be able to store the partially used bottle. However, the storage of a partially used bottle is objectionable because bacteria present in the infant's saliva may ooze through the nipple into the milk remaining in the bottle. This increases the rate of spoilage of the remaining milk.

This problem of spoilage is especially troublesome when feeding infants who take only small amounts of milk at each feeding thereby extending the periods during which the conventional partially filled nursing bottle must be stored.

OBJECTS AND SUMMARY OF THE INVENTION

It is an object of the present invention to provide a dual chamber nursing bottle which enables the storage of milk in a storage chamber and the dispensing of the milk from the storage chamber into a feeding chamber.

Another object of the present invention is to provide a dual-chamber nursing bottle which can be conveniently operated with one hand.

Another object of the present invention is to provide a dual-chamber nursing bottle which can be easily cleaned.

Yet another object of the present invention is to provide a dual-chamber nursing bottle which includes a relatively small number of relatively simple component parts which can be manufactured economically in volume, resulting in a relatively low overall cost.

Additional objects and advantages of the present invention will appear more clearly hereinafter.

In accordance with the present invention, there is provided a dual-chamber nursing bottle which includes a first, relatively larger, storage chamber and a second, relatively smaller feeding chamber. A soft rubber nursing nipple is connected to the second chamber for feeding an infant. The first and second chambers are connected by a threaded closure. A transfer valve is mounted on the threaded closure to allow the transfer of selected quantities of milk from the first chamber into the second chamber.

In the primary embodiment of the invention, the transfer valve is formed as a unitary valve member which is made of a flexible material such as a food grade rubber or plastic material. The valve member includes an activation portion which projects through an aperture which is formed in the threaded closure and which connects the first and the second chamber. The valve member includes an aperture which leads to a slit which has a normally closed portion. The slit is oriented generally parallel to a longitudinal axis of the valve member. Manual pressure on the activation portion in a direction which compresses the valve member forces the slit portion to open and allows milk to flow from the first chamber to the second chamber.

In an alternative embodiment of the invention, the transfer valve is formed as a unitary valve member which is made of a flexible material such as a food grade rubber. The valve member has a circular cup-shaped portion and a central stem portion. The stem portion engages a cover which separates the storage chamber and the feeding chamber. The cup-shaped portion bears against the cover to prevent flow through apertures in the cover when the nursing bottle is not in use.

BRIEF DESCRIPTION OF THE DRAWINGS

Other important objects of the present invention will be apparent from the following detailed description of the invention taken in connection with the accompanying drawings in which:

FIG. 12 is a side elevation view of the insert member of FIG. 10;

FIG. 13 is a cross-section view taken along the line 13-13 of FIG. 12;

FIG. 14 is a partial cross-sectional view of the valve member of the embodiment of FIG. 9 with the valve member drawn to an enlarged scale;

DETAILED DESCRIPTION OF THE INVENTION

Figure 1:
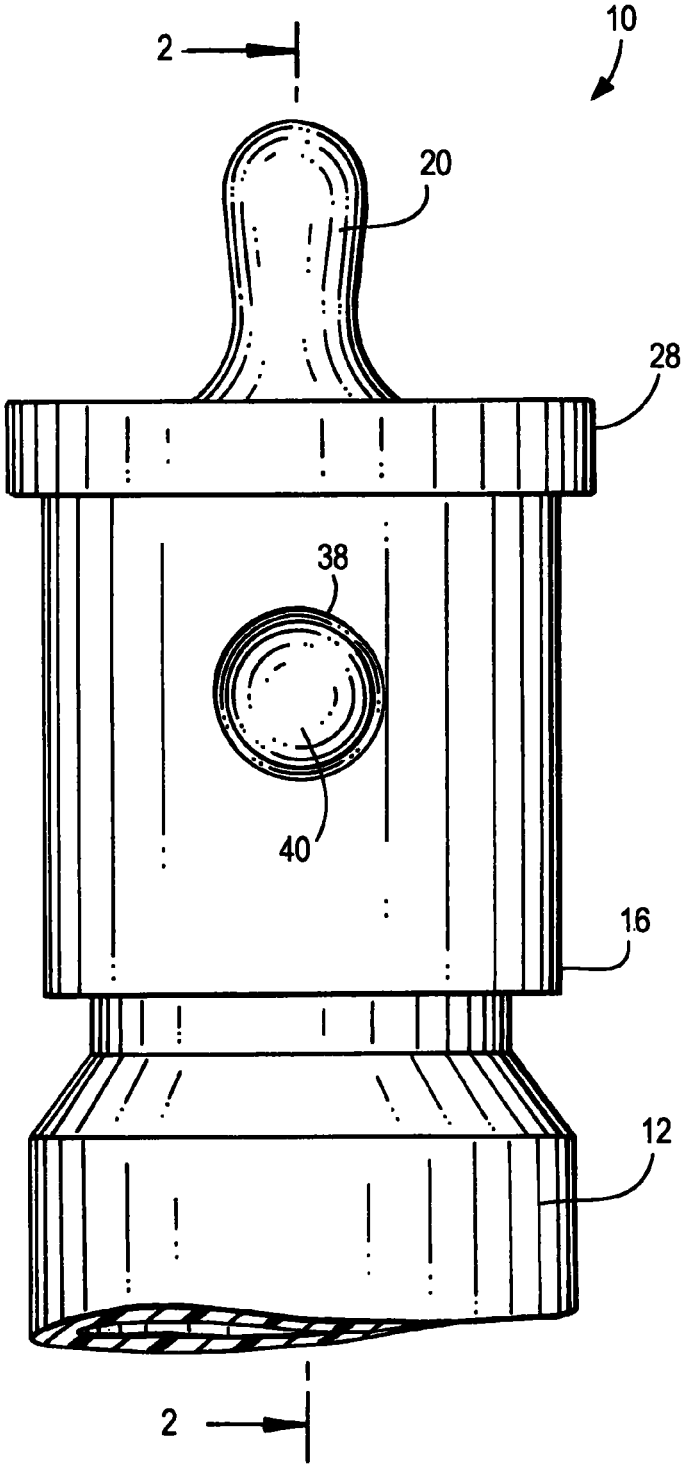
FIG. 1 is a fragmentary elevation view of the primary embodiment of a dual chamber nursing bottle made according to the present invention.
Figure 3:
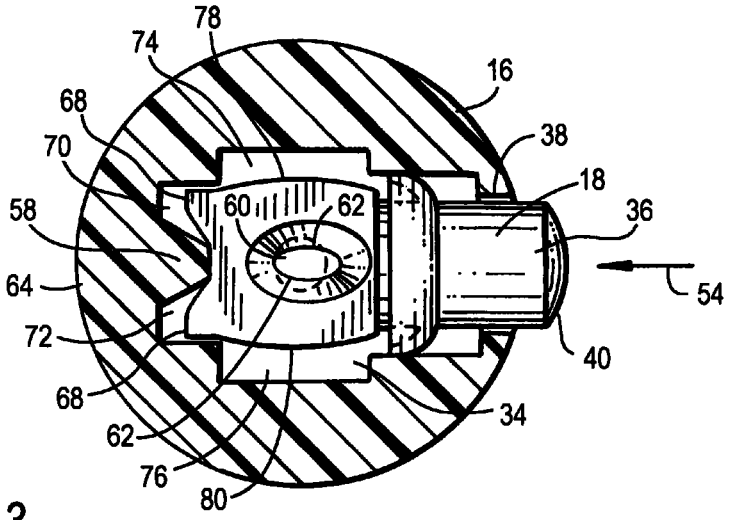
FIG. 3 is a cross-sectional view taken along the line 3-3 of FIG. 2 showing the valve member in the open position.

With reference to the drawings, there is shown in FIG. 1 a dual chamber nursing bottle 10, made in accordance with the present invention which comprises a first chamber 12, a second chamber 14, a closure 16 which defines the second chamber 14, a valve member 18, and a nursing nipple 20.

Figure 2:
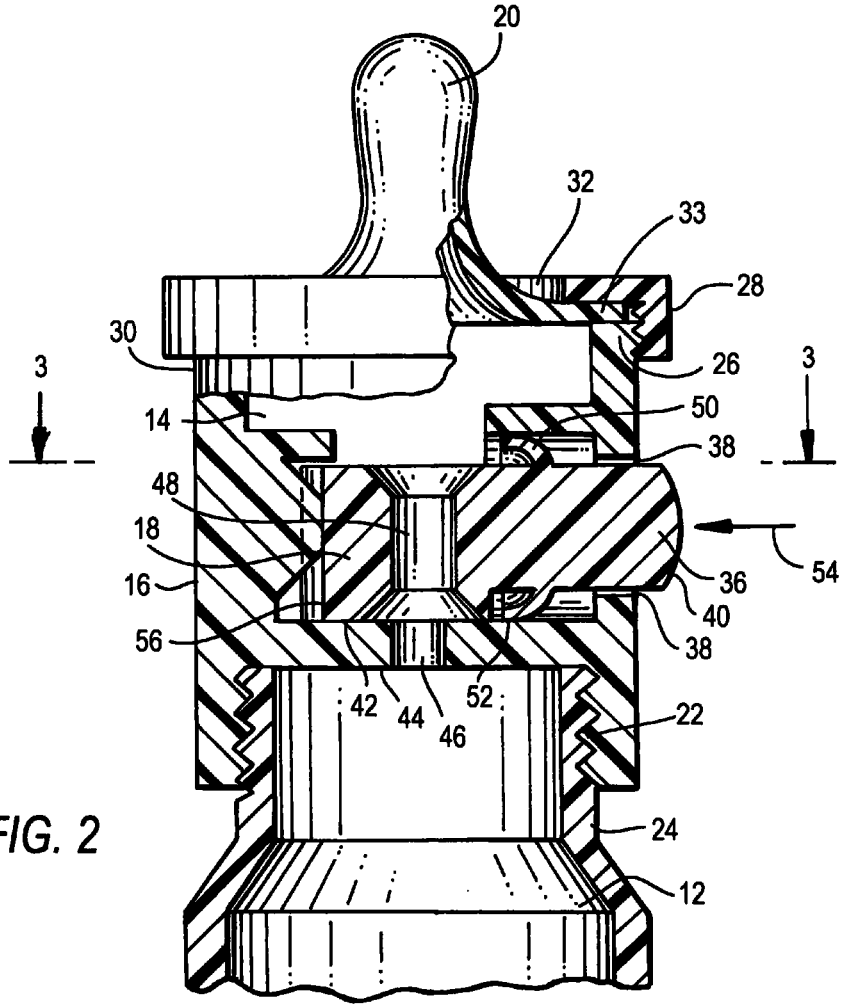
FIG. 2 is a cross-sectional view taken along the line 2-2 of FIG. 1.
Figure 4:
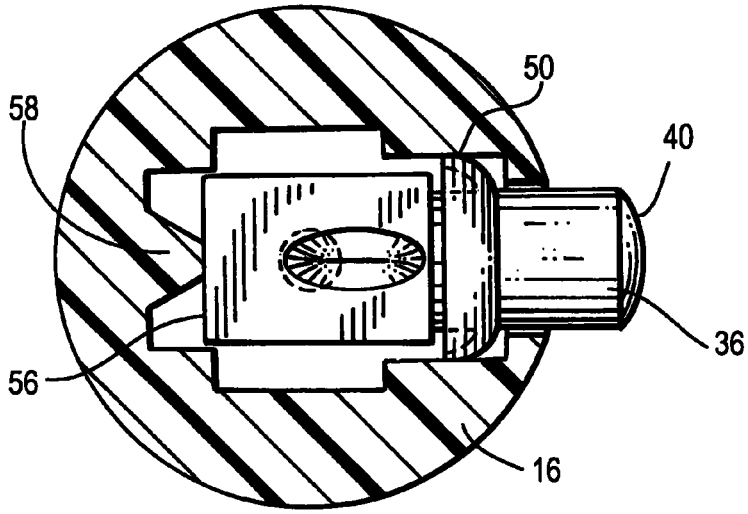
FIG. 4 is a cross-sectional view taken along the line 3-3 of FIG. 2 similar to FIG. 3 showing the valve in the closed position.
Figure 5:
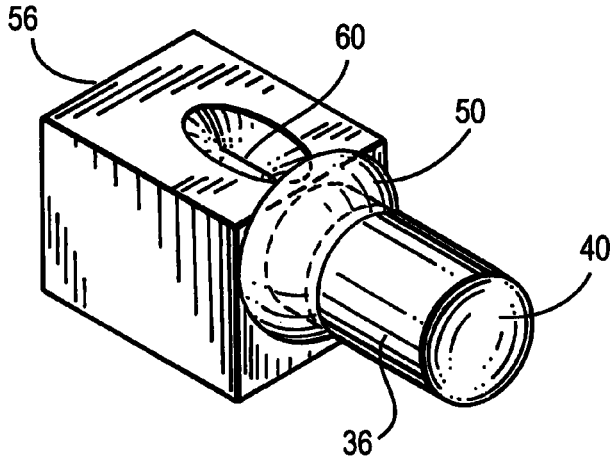
FIG. 5 is a perspective view of the valve member with the valve member shown removed from the apparatus of FIG. 1.

As is best shown in FIG. 2, the first or relatively larger chamber 12 is generally cylindrical and has the overall configuration of a conventional nursing bottle. The lower end of the closure 16 includes a first threaded portion 22, which is threaded onto the upper end 24 of the first chamber 13.

In addition to the first threaded portion 22 which engages the first chamber 12, the closure 16 includes a second threaded portion 26 which engages the cap 28.

The cap 28 is threaded onto the upper end 30 of the closure 16 as is shown in FIG. 2. A conventional nursing nipple 20 projects through an aperture 32 in the cap 28 and is retained by the cap 28 which bears on the flange 33 which is formed on the nipple 18.

The valve member 18 which forms an important feature of the present invention is mounted in a cavity 34 which is formed in the closure 16. The valve member 18 is a unitary member which is made of a flexible material such as food or medical grade rubber or plastic. The valve member 18 includes a projecting portion 36 which projects through an aperture 38 formed in the closure 16 in a generally radially radial direction relating to the closure 16. The outer end 40 of the projecting portion 36 is convexly rounded and projects beyond the curved surface 40 of the closure 16.

The lower portion 42 of the valve member 18 rests on the plate portion 44 of the closure 16. The plate portion 44 of the closure 16 includes an aperture 46. The aperture 46 is generally in line with a normally closed aperture 48 formed in the valve member 18.

The valve member 18 includes a relatively thin lip portion 50 which is proportioned to bear against the surface 52 of the aperture 38 thus forming a seal.

The aperture 48 formed in the valve member 18 is normally closed. Pressure exerted by a user in the direction shown by the arrow 54 in FIG. 2 causes the end 56 of the valve member 18 to bear against the projecting portion 58 of the closure 16 and forces a slit 60 formed by wall portion 62 defining the aperture 48 to open. As is shown in FIG. 2, the portion 64 of the closure 16 includes the projecting portion 58 against which the end 68 of the valve member 18 bears.

The cavity area 70, 72 adjacent to the projecting portion 58 provides room for the end 68 of the valve member 18 to flex into as pressure is applied to the projecting portion 36. The projecting portion 58 of the closure 16 is generally in line with the slit 60 and forces the slit 60 to open when pressure is applied to the projecting portion 36. The closure 16 includes opposition cavity portions 74, 76 which accommodate the flexing and bulging of the sides 78, 80 of the valve member 18 when pressure is applied to the valve member 18.

When pressure is applied to the projecting portion 36 of the valve member 16, the slit 60 is forced open and milk or other fluid in the first chamber 12 can flow into the second chamber 14. Releasing the pressure on the valve member 18 allows the elastic properties of the valve member 18 to close the slit 60 thereby sealing the first chamber 12.

The valve member 18 thus enables a user to transfer a desired quantity of fluid such as milk, from the first chamber 12 to the second chamber 14 and then feed an infant using the nursing nipple 20. When the feeding has been completed, the unused milk is retained in the first chamber 12 which remains sealed through the action of the valve member 18. The nursing bottle 10 according to the invention can be stored under refrigeration as desired with the fluid which is in the first chamber 12 remaining in a clean and uncontaminated condition.

Figure 7:
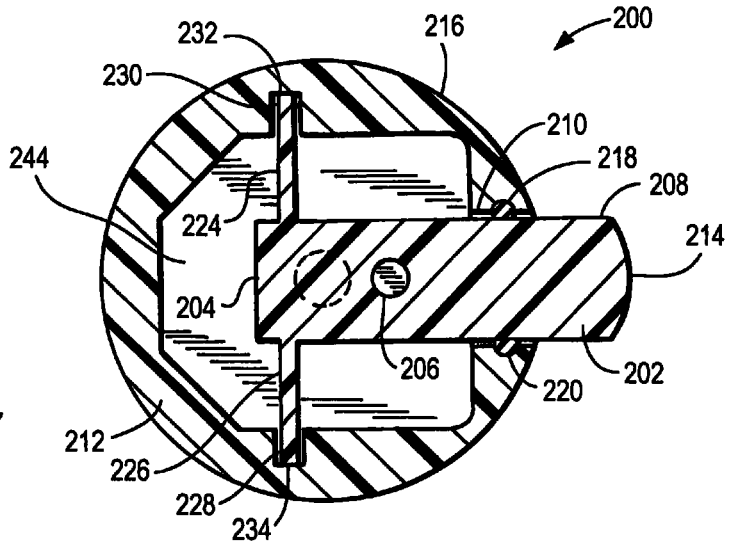
FIG. 7 is a cross-sectional view taken along the line 7-7 of FIG. 6 showing the valve member in the closed position.
Figure 6:
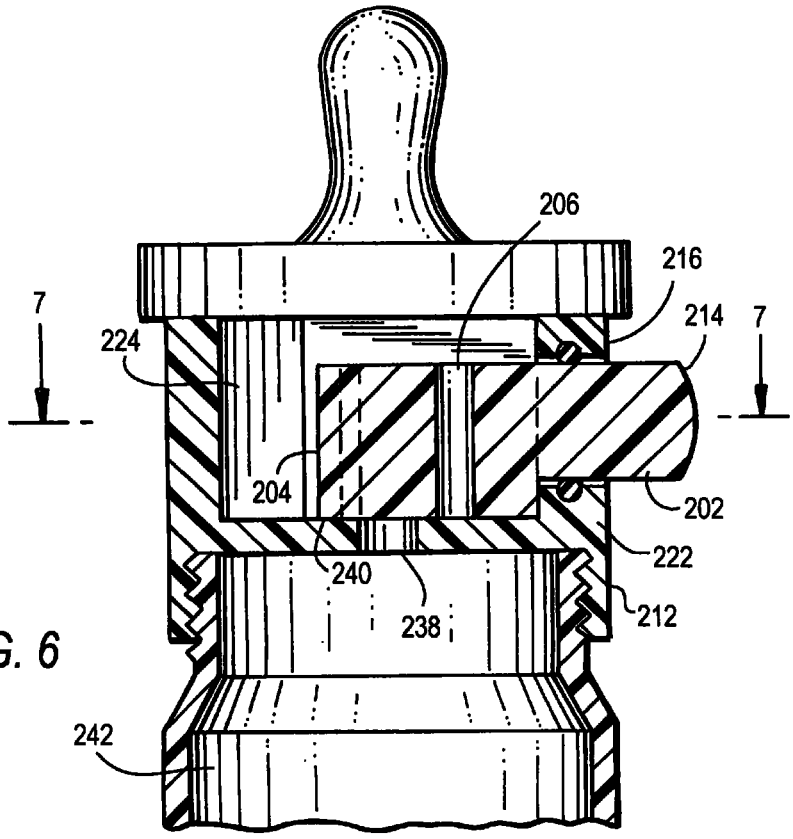
FIG. 6 is a cross-section view similar to FIG. 2 showing a second alternate embodiment of the invention.
Figure 8:
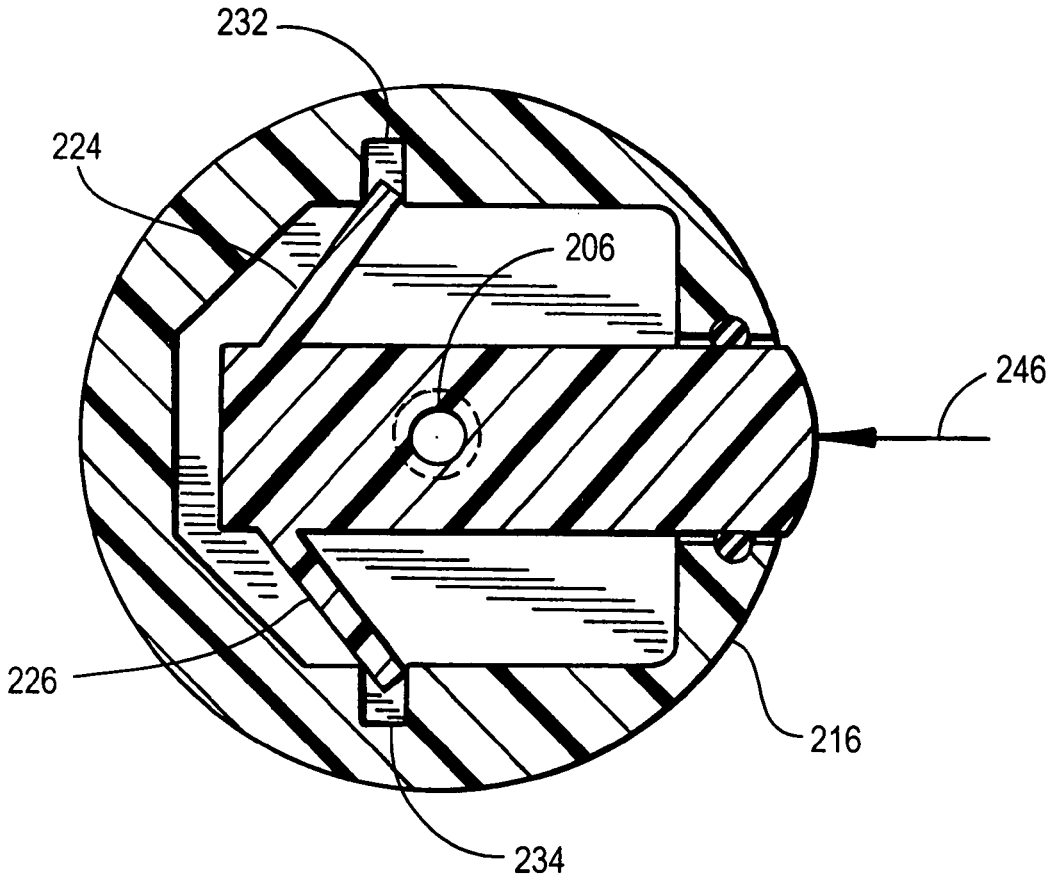
FIG. 8 is a cross-sectional view taken along the line 7-7 of FIG. 6 similar to FIG. 7 showing the valve member in the open position.

FIGS. 6-8 show a second embodiment of the invention 200 in which the valve member 18 is replaced by a sliding valve member 202. As is shown in FIG. 6, the sliding valve member 202 is an integrally formed member which may be made of a flexible medical or food grade rubber or plastic material. The valve member 202 includes a body portion 204 which has a bore 206 and a projecting portion 208 which projects through an aperture 210 which is formed in the closure 212. The end 214 of the projecting portion 208 is convexly rounded and projects past the outer surface 216 of the closure 212. An O-ring seal 218 is lodged in a groove 220 which is formed in an intermediate portion 222 of the closure 212. The O-ring seal 218 prevents leakage of fluid from the closure 212.

The valve member 202 also includes a pair of oppositely directed flange portions 224, 226. The outer ends 228, 230 of which are lodged in apertures 232, 234, which are formed in the closure 212. The flange portions 224, 226 act as springs and maintain the normally closer position of the valve member 202. As shown in FIGS. 6 and 7 in which the bore 206 is not in alignment with the aperture 238 in the closure 212 and the surface 240 of the valve member 207 blocks the flow of fluid from the first chamber 242 into the second chamber 244.

When the projecting portion 208 is pressed inwardly in the direction shown by the arrow 246 in FIG. 8, the flange portions 224, 226 flex and the bore 206 comes into alignment with the aperture 238 in the closure 212 allowing fluid to flow from the first chamber 242 into the second chamber 244.

The operation of nursing bottle 200 of FIGS. 6-8 is thus the same as the operation of the nursing bottle 10 as previously described.

FIGS. 9-14 show a third alternative embodiment of the invention 300 which includes an insert member 302 which is snap fit into a conventional nursing nipple 304.

Figure 9:
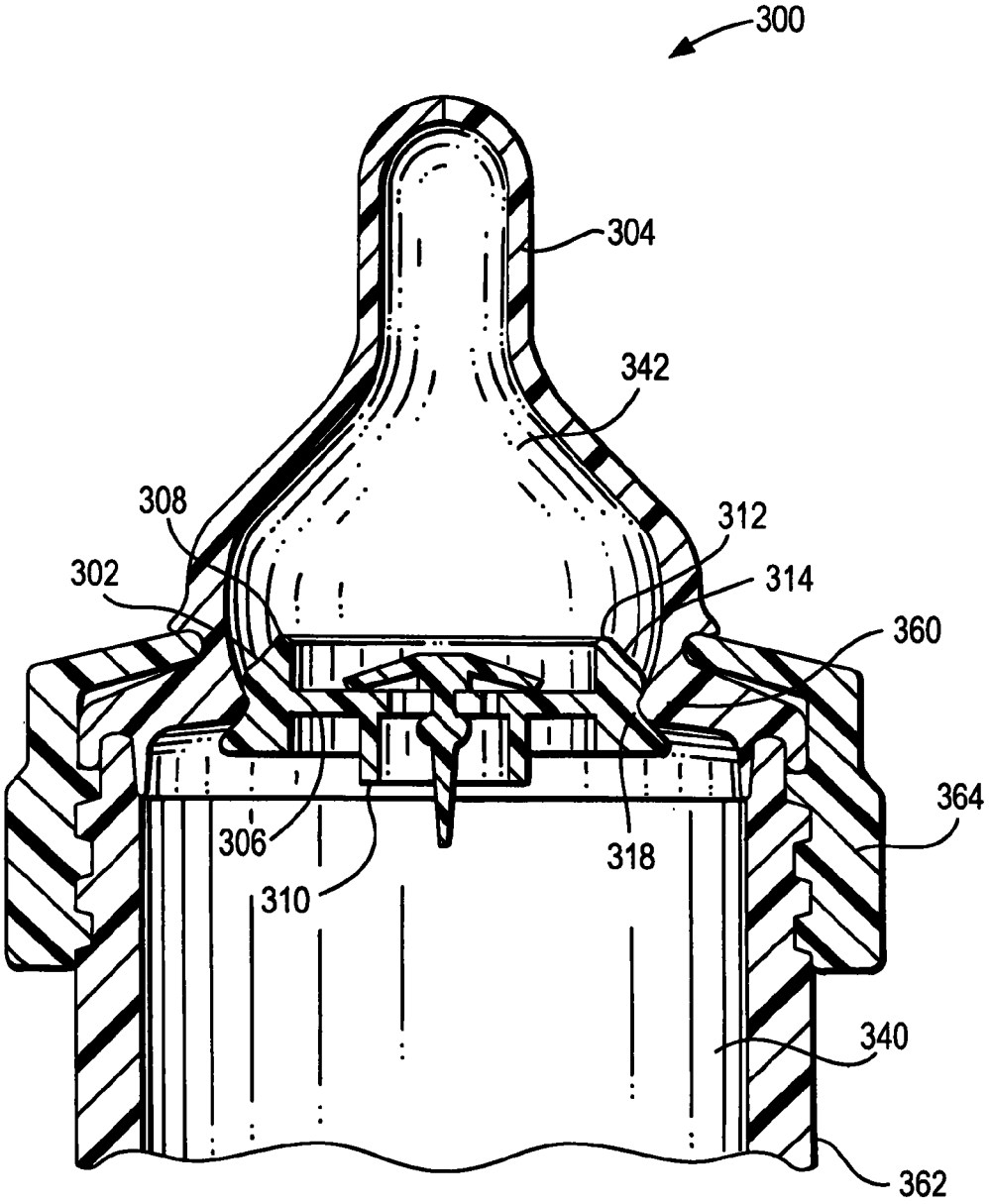
FIG. 9 is a cross-sectional view of a third alternative embodiment of the invention.
Figure 10:
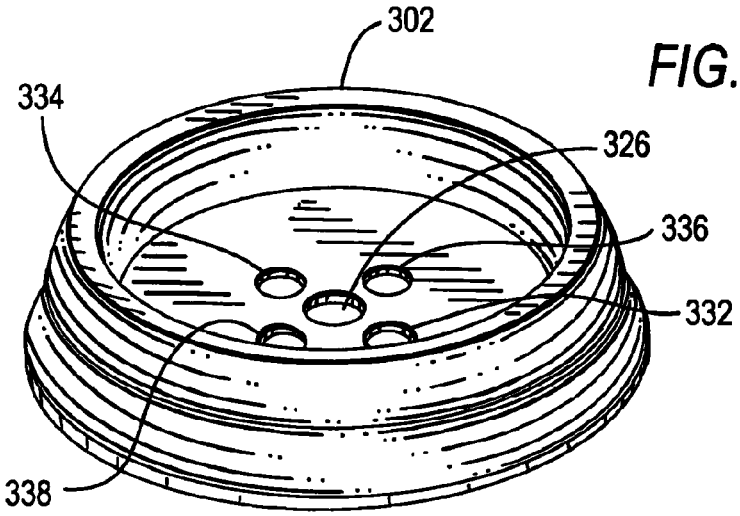
FIG. 10 is a perspective view of an insert member which is part of the embodiment of FIG. 9.
Figure 11:
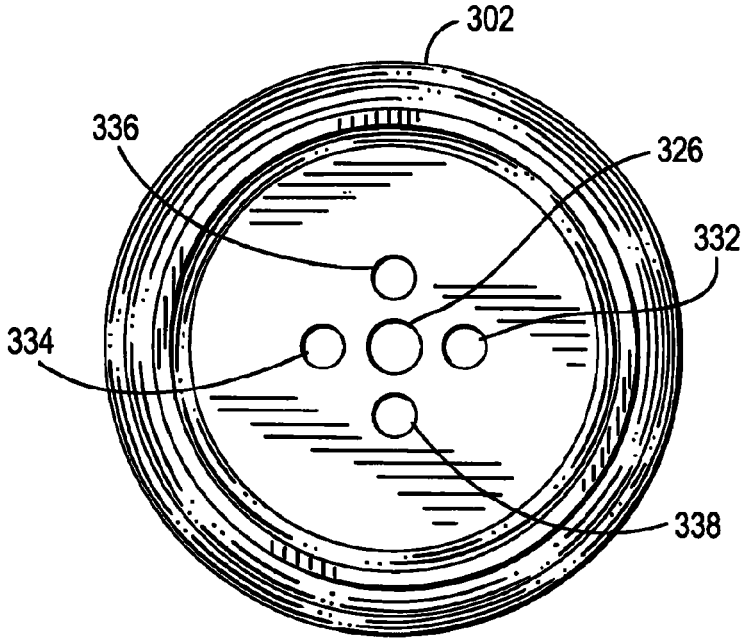
FIG. 11 is a top plan view of the insert member of FIG. 10.

The insert member 302 is best shown in FIG. 9 includes a central circular portion 306 which has a peripherally disposed upwardly directed flange portion 308 and a generally centrally disposed downwardly directed flange portion 310. The downwardly directed flange portion 310 is generally cylindrical in configuration.

The upper edge 312 of the upwardly directed flange portion 308 is rounded and is adjacent to a first outwardly flared portion 314. The lower edge 316 of the outwardly flared portion 314 is adjacent to an inwardly curved or concave portion 318. The lower portion 320 of the concave portion 318 is adjacent to a second outwardly flared portion 322.

The upper surface 324 of the central portion 306 and the concave portion 318 are smoothly finished and form sealing surfaces in a manner which will be presently described.

The central portion 306 includes a central aperture 326 through which the valve stem 328 of the valve member 330 projects and form flow apertures 332, 334, 336, 338 through which fluid flows from the storage chamber 340 to the feeding chamber 342 when the nursing bottle 300 is in use.

The valve member 330 is a unitary member which includes a flexible conical portion 344 and a central projecting valve stem 328. The valve stem 328 includes a first cylindrical portion 346, a second cylindrical portion 348 of reduced diameter, a spherical portion 350 and a tapered portion 352. The tapered portion 352 enables the valve member 328 to be inserted and pushed through the central aperture 326 of the insert member 302. The lower surface 358 of the first cylindrical portion 346 and the spherical portion 350 retain the valve member 330 on the insert member 302. The outer lip 356 of the conical portion 344 of the valve member 330 bears against the surface 324 of the insert member 302 forming a sealing relationship. The valve member 330 thus blocks the flow of fluid from the storage chamber 340 into the feeding chamber. When there is reduced pressure in the feeding chamber during nursing, the conical portion flexes and allows fluid to flow from the storage chamber into the feeding chamber.

As is best shown in FIG. 9, during use, the first tapered portion 314 of the insert member 302 is pressed into a conventional nursing nipple 304. The concave portion 318 of the insert member 302 forms a sealing relationship with the inwardly projecting portion 360 of the nursing nipple which the second tapered portion 322 retains the insert 302 in place.

The nursing nipple is mounted on a conventional nursing bottle 362 and is retained in place by a conventional threaded lock ring or collar 364. The valve member 330 and the insert member 302 are made of medical grade sterilizeable rubber.

Figure 15:
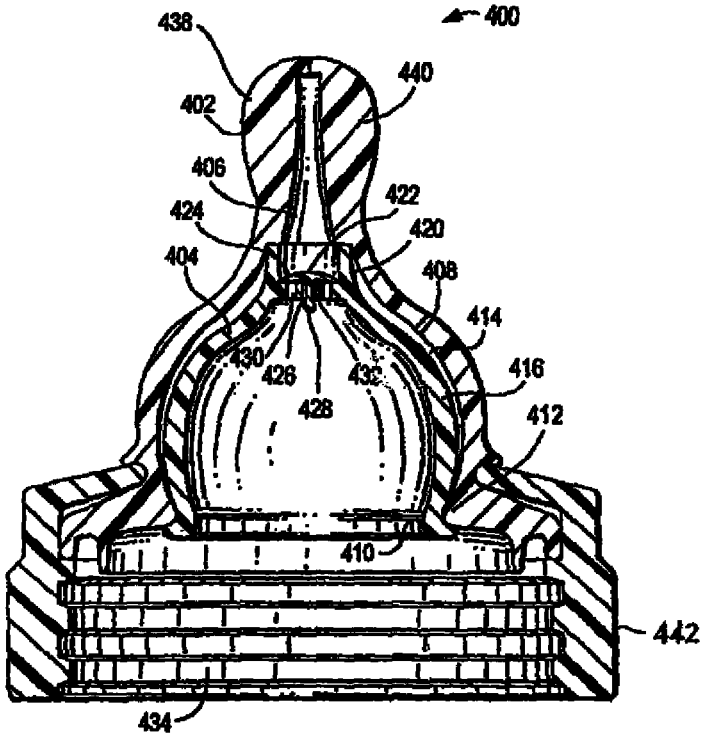
FIG. 15 is a cross-sectional view of a fourth alternative embodiment of the invention incorporating a nipple and a feeding chamber with reduced volume.

FIG. 15 shows a fourth embodiment of the invention 400 in which the shape of the nipple 402 and the insert 404 have been modified in order to reduce the volume of air in the feeding chamber 406.

The advantages of this embodiment 400 include a reduction in air intake during feeding thus reducing the likelihood of colic and burping. In addition, the reduced volume of air makes it easier for the infant to get milk when he/she starts sucking.

In the fourth embodiment 400, the insert member 302 of FIG. 9 has been replaced with the generally dome shaped insert 404. The general contour of the insert 404 generally conforms to the contour of the inner surface 408 of the nipple 402. The lower portion 410 of the insert engages the internal portion 412 of the nipple 402 in the manner previously described. The chamber 414 is generally defined by the outer surface 416 of the insert 404 and the inner surface 408 of the nipple 402.

The upper portion 418 of the insert 404 includes an upwardly projecting flange 420 and a valve 422.

The valve 422 is generally similar to the valve member 330. The valve 422 includes a dome-shaped sealing portion 424 and a central stem 426 which terminates in a ball portion 428. The ball portion 428 is retained by the insert 404. The insert 404 includes flow apertures 430, 432 which permit flow from the storage chamber 434 to the feeding chamber 406 when the sucking of the infant on the nipple 402 opens the valve.

The nipple 402 has side portions 438, 440 of increased thickness to further reduce the volume of the feeding chamber 406.

The collar 442 is similar to the collar 364 previously described in connection with FIG. 9. The exact shape of the nipple 402 and insert may be varied in order to adjust the mouth feel of the nipple 402. The insert may be made of a semi-rigid material instead of hard plastic to improve mouth feel while the infant is feeding.

Figure 16:
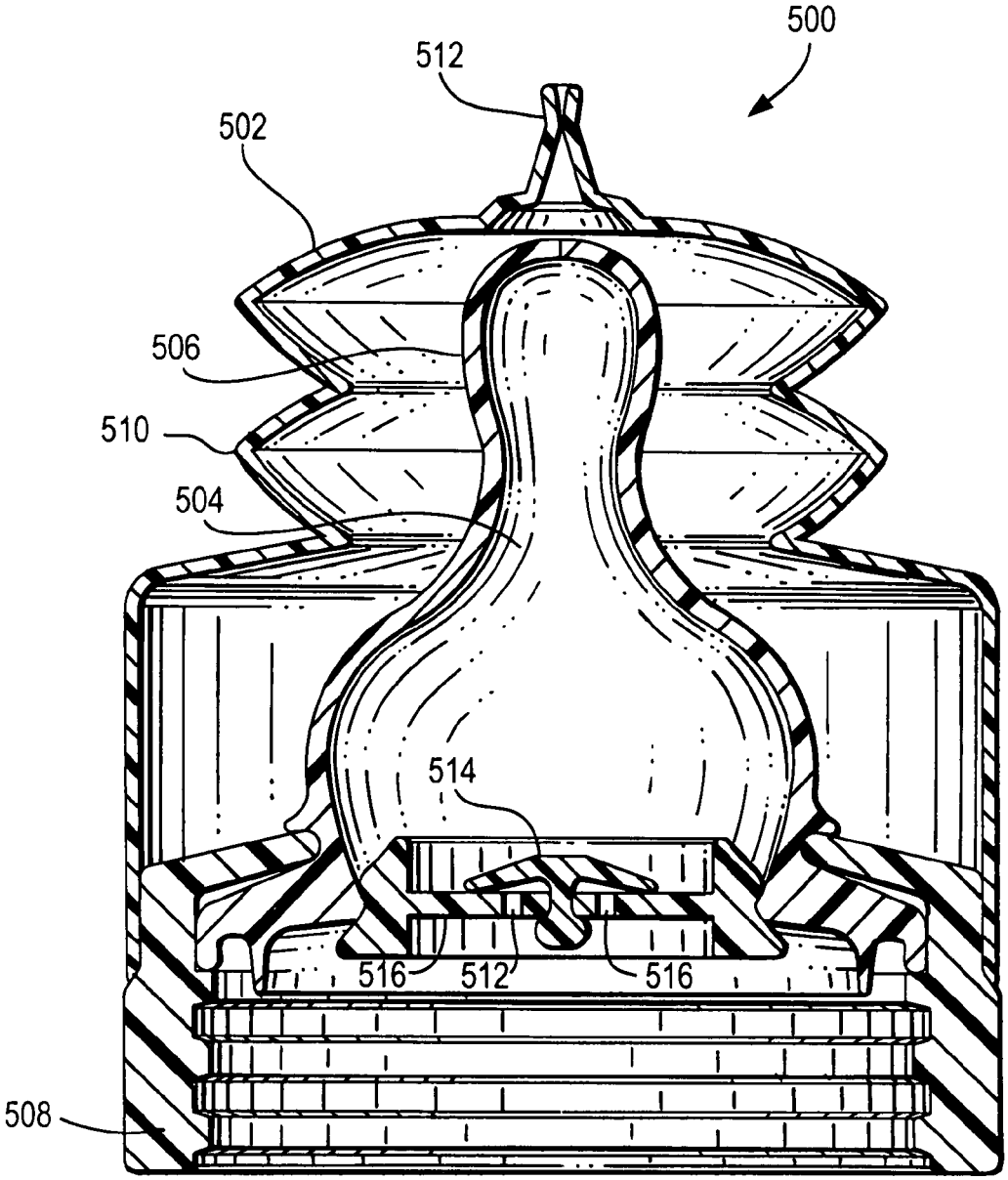
FIG. 16 is a cross-sectional view of a fifth alternative embodiment of the invention incorporating a priming pump cap.

FIG. 16 shows a fifth alternative embodiment of the invention 500 which is generally similar to the third embodiment of the invention 300 as described in connection with FIG. 9 with the addition of the priming pump cap 502.

The priming pump cap 502 enables the parent to fill the feeding chamber 504 inside the nipple 506 with milk before the infant starts feeding. This makes it possible for the infant to get milk when he/she starts sucking on the nipple 506. The reduced air intake reduces the likelihood of colic and burping.

The cap 502 fits over the collar 508 and includes a flexible accordion-like portion 510 and a central duckbill valve 512.

The valve 514 is similar to the valve 418 which has been described in connection with FIG. 15. The insert 516 is snap fit into the nipple 508 and includes flow apertures 512, 515. Flow through the apertures 512, 516 is controlled by valve 514.

The cap 502 can be made from a semi-rigid material. It may be a blow molded part with accordion-like bellows to allow compression and expansion. The duckbill valve 512 is permanently attached to the cap in a manner that creates a seal between the valve 512 and the cap 502. When the parent pushes down on the cap 502, it compresses the nipple 506 and forces air out of the nipple 506 and through the duckbill valve 512, which allows air to escape into the atmosphere. When the parent releases the cap 502, the duckbill valve 512 closes and the cap 502 expands upward. The nipple 506 relaxes back into its natural shape. This expansion of the nipple 506 draws milk into the nipple feeding chamber 504. The fact that the pump feature is built into the cap 502 allows the parent to prime the nipple 506 without touching the nipple 506, which could adversely affect its sterilization.

FIGS. 17-20 show a sixth embodiment of the invention 600 which includes an insert 602 and an inner cap 604 which cooperate to form a valve bypass assembly 606. The inner cap 604 has a flange 640 which closely fits the inner surface 608 of the bottle 610 and cannot rotate relative to the bottle 610.

The insert 602 fits into the lower portion 612 of the nipple 614 and includes projecting ribs 616 which prevent rotation relative to the nipple 614.

The inner cap 604 includes three curved or arcuate slot-like openings 618, 620, 622 for bypass flow and a central opening 624 for flow through the valve 626.

The insert 602 includes three circular openings 628, 630, 632 for bypass flow and central openings 634, 636, 638 for flow through the valve 626. The valve 626 is generally similar to the valves previously described.

Figure 17:
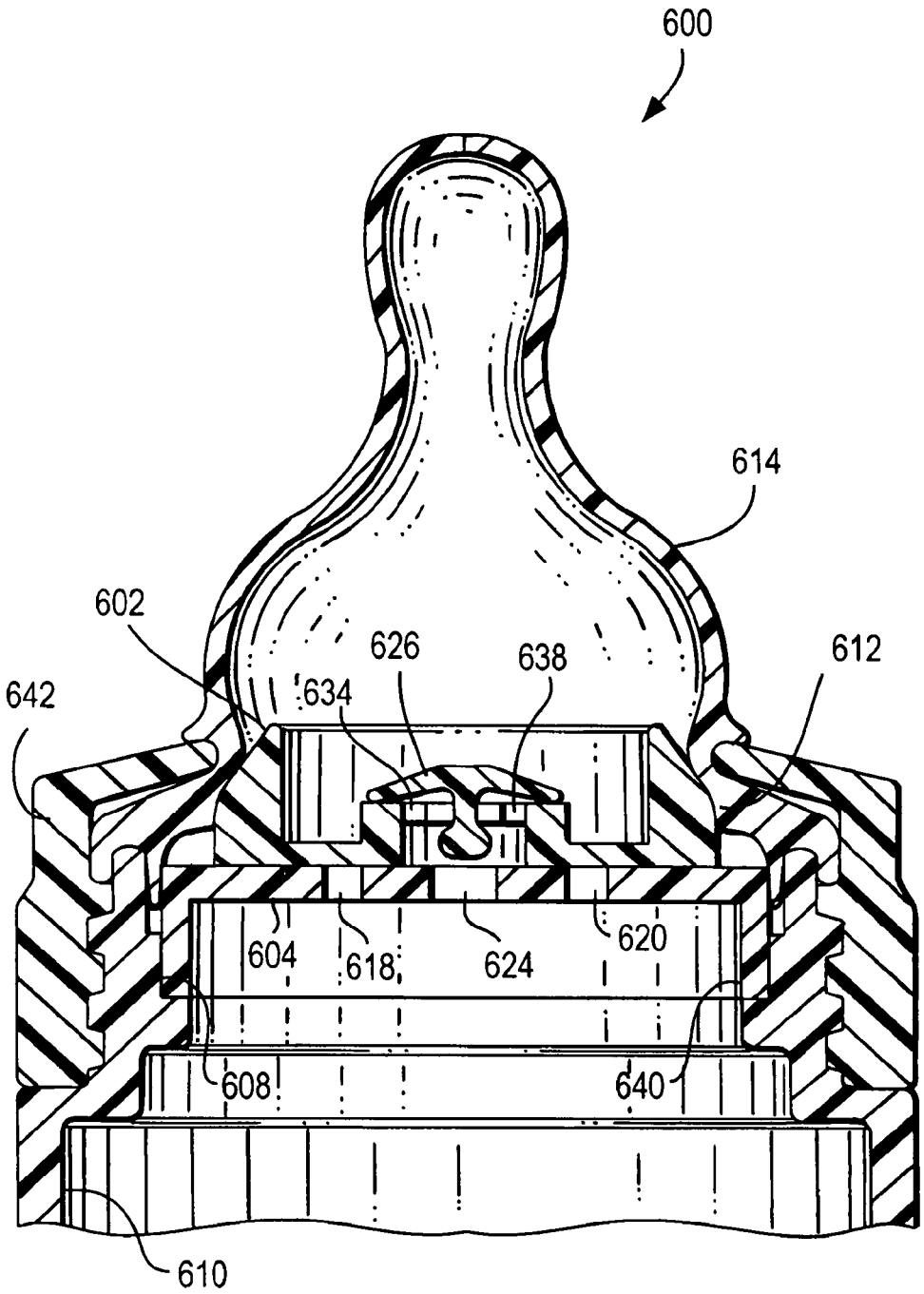
FIG. 17 is a cross-sectional view of a sixth alternative embodiment of the invention incorporating a valve bypass member and showing the valve bypass in the closed position.
Figure 18:
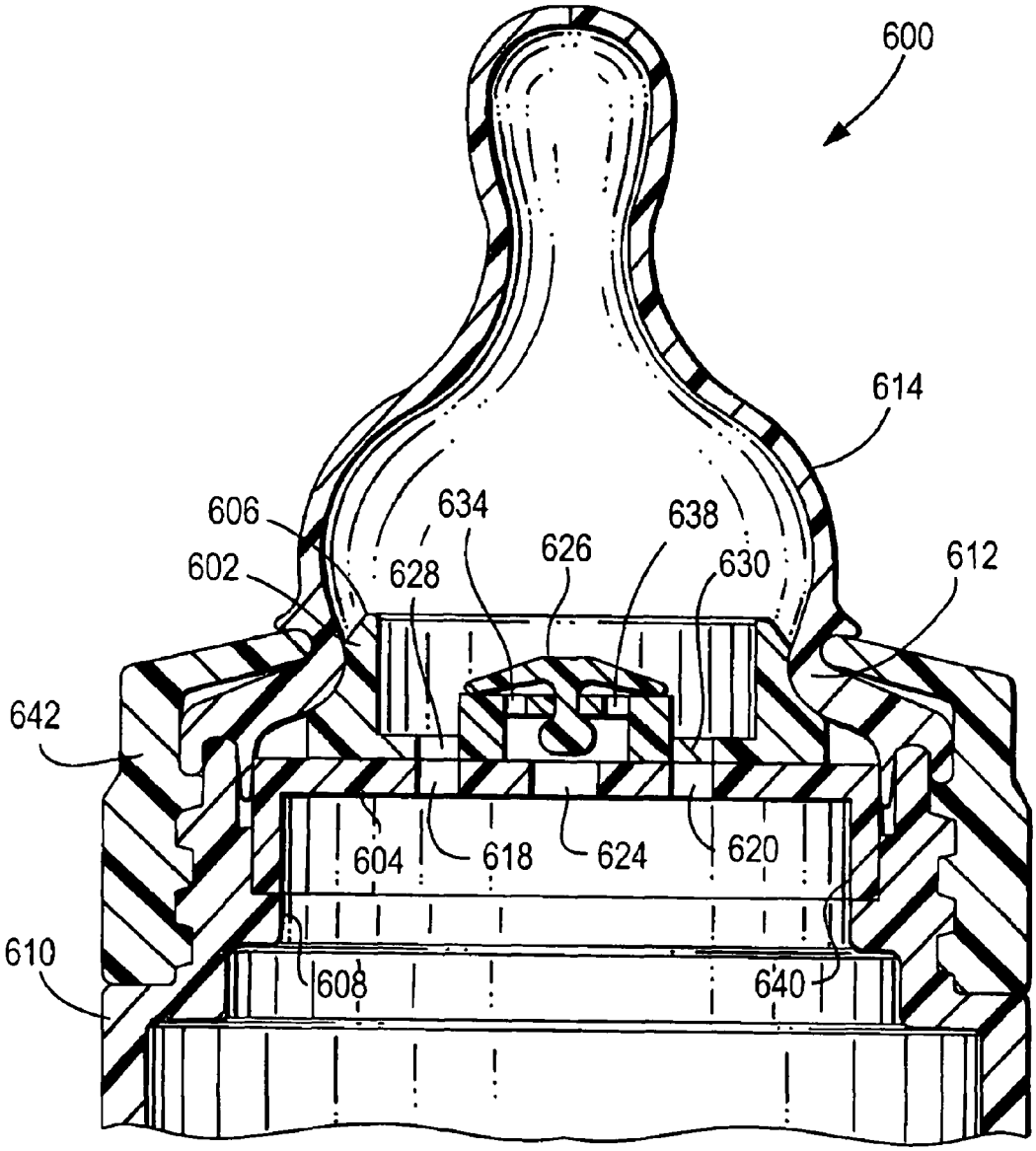
FIG. 18 is a cross-sectional view similar to FIG. 17 showing the valve bypass in the open position.
Figure 19:
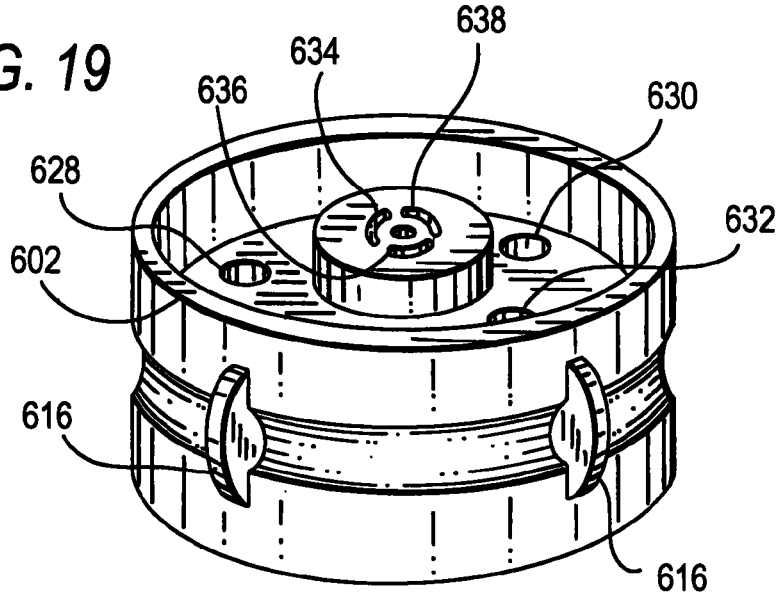
FIG. 19 is a perspective view of an insert member which is part of the embodiment of FIG. 17.
Figure 20:
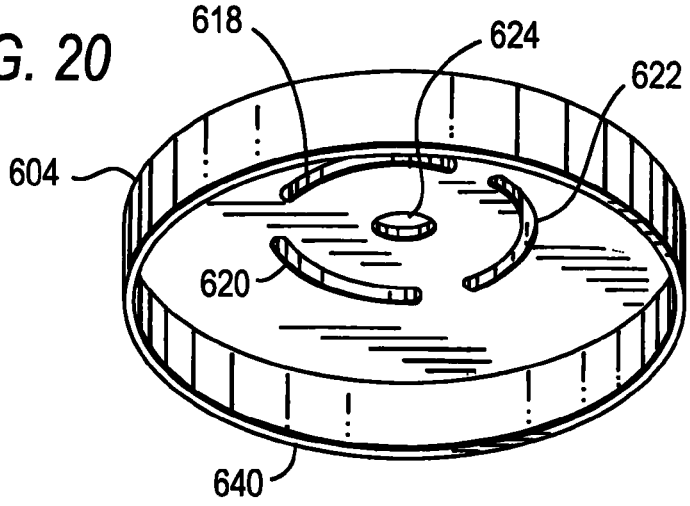
FIG. 20 is a perspective view of an inner cap which is part of the embodiment of FIG. 17

The operation of the sixth embodiment 600 includes the following steps. The bottle 610 is filled with milk. At this point, there are no additional components assembled to the bottle 610. The inner cap 604 is affixed to the bottle. This is a sealed fit around the flange 640 of the inner cap 604. The inner cap 604 cannot rotate relative to the bottle 610 due to tight fit. The nipple 614, insert 602 and collar 642 are assembled as shown in FIG. 17 and partially screwed onto the bottle 610. The insert 602 cannot rotate relative to the nipple 614 due to locking ribs 616. The valve bypass flow slots 618, 620, 622 in the inner cap 604 are lined up with the valve bypass holes 628, 630, 632 in the insert 602. This insert 602 and inner cap 604 orientation is shown in FIG. 17. The alignment of the valve bypass openings in the insert and inner cap 618, 620, 622, 628, 630, 632 may be done visually, or may be accomplished by projecting features (not shown) to create a tactile or audible click between the insert 602 and inner cap 604 when the alignment is correct. The bottle 610 is inverted and milk flows through the valve bypass holes and slots 618, 620, 622, 628, 630, 632 filling the nipple feeding chamber. The nipple/insert assembly 606 is fully screwed on the bottle 610 so that the insert 602 seals against the inner cap 604. The valve bypass holes 618, 620, 622 are no longer aligned, so that the only flow path is through the valve 626.

The foregoing specific embodiments of the present invention as set forth in the specification herein are for illustrative purposes only. Various deviations and modifications may be made within the spirit and scope of this invention without departing from the main theme thereof.

What is claimed is:

1. A dual chamber pursing bottle comprising;

a nursing nipple having a hollow portion;

a bottle with said nursing nipple mounted on said bottle;

an insert member disposed communicating with said hollow portion of said nursing nipple and thereby forming a storage chamber generally defined by said bottle and a feeding chamber;

valve means mounted on said insert member, with said valve means communicating between said storage chamber and said feeding chamber, with said valve means normally closed and with said valve means opened responsive to reduced pressure in said feeding chamber; and a bypass valve disposed on said insert member and disposed to bypass said said valve means, said bypass valve comprising an inner cap disposed below said insert means.

2. The dual chamber nursing bottle as claimed in claim 1 wherein said insert member comprises:

a central aperture portion and wherein said valve means comprises;

a valve stem portion with said valve stem portion disposed passing through said central aperture portion.

3. The dual chamber nursing bottle as claimed in claim 1 wherein said valve means is connected to said insert member.

4. The dual chamber nursing bottle as claimed in claim 1 wherein said valve means comprises a generally conical portion.

5. The dual chamber nursing bottle as claimed in claim 1 wherein said valve means comprises a sealing lip portion.

6. The dual chamber nursing bottle as claimed in claim 1 wherein said insert member comprises a flange portion with said flange portion forming a sealing relationship with said hollow portion of said nursing nipple.

7. The dual chamber nursing bottle as claimed in claim 1 wherein said insert member further comprises a central ring portion.

8. The dual chamber nursing bottle as claimed in claim 1 wherein said insert member further comprises a sealing surface for sealing against said nursing nipple.

* * * * *